US006779464B1

(12) United States Patent
Yamato

(10) Patent No.: US 6,779,464 B1
(45) Date of Patent: Aug. 24, 2004

(54) GAS GENERATING COMPOSITION

(75) Inventor: Yo Yamato, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/530,184

(22) PCT Filed: Sep. 8, 1999

(86) PCT No.: PCT/JP99/04876

§ 371 (c)(1),
(2), (4) Date: Apr. 26, 2000

(87) PCT Pub. No.: WO00/15584

PCT Pub. Date: Mar. 23, 2000

(30) Foreign Application Priority Data

Sep. 14, 1998 (JP) ..... 10-259566

(51) Int. Cl.[7] ..... C06D 5/00; C06B 31/00; C06B 29/22

(52) U.S. Cl. ..... 102/531; 149/45; 149/76

(58) Field of Search ..... 102/531; 149/45, 149/76, 19.91

(56) References Cited

U.S. PATENT DOCUMENTS 5,780,768 A * 7/1998 Knowlton et al. ..... 149/36
5,861,571 A * 1/1999 Scheffee et al. ..... 102/288
6,093,269 A * 7/2000 Lundstrom et al. ..... 149/36
6,123,359 A * 9/2000 Cabrera et al. ..... 280/741
6,224,099 B1 * 5/2001 Nielson et al. ..... 280/741
6,235,132 B1 * 5/2001 Knowlton et al. ..... 149/36

FOREIGN PATENT DOCUMENTS

| | | |
|---|---|---|
| EP | A1767155 | 4/1997 |
| EP | A2820971 | 1/1998 |
| EP | A1861817 | 9/1998 |
| JP | A4265292 | 9/1992 |
| JP | A6239683 | 8/1994 |
| JP | A7196392 | 8/1995 |
| JP | A9501137 | 2/1997 |
| WO | A2-9525709 | 9/1995 |
| WO | A1-9718178 | 5/1997 |
| WO | A1-9943633 | 9/1999 |

* cited by examiner

*Primary Examiner*—Aileen B. Felton
(74) *Attorney, Agent, or Firm*—Birch, Stewart, Kolasch & Birch, LLP

(57) ABSTRACT

A gas generating composition is obtained in which an amount of a combustion residue based on a unit amount of a gas generated is reduced.

A gas generating composition comprising nitroguanidine, guanidine nitrate or a mixture thereof as a fuel and further an oxidizing agent. The oxidizing agent is a perchloric acid salt, a nitric acid salt or a mixture thereof, and when the oxidizing agent is ammonium perchlorate, a chlorine neutralizer is further incorporated.

7 Claims, No Drawings

GAS GENERATING COMPOSITION

This application is the national phase under 35 U.S.C. § 371 of PCT International Application No. PCT/JP99/04876 which has an International filing date of Sep. 8, 1999, which designated the United States of America.

TECHNICAL FIELD TO WHICH THE INVENTION BELONGS

This invention relates to a gas generating composition which is suitable as a gas generating agent for an air bag system installed in automobiles, airplanes and the like for protecting human bodies.

PRIOR ART

Various requirements have been put forth on a gas can generating agent for an air bag inflator. It is one of the requirements that a combustion residue after combustion should be reduced. When a combustion residue generated by combustion of a gas generating agent is released outside an inflator, there occur a first problem that a combustion residue having a great heat capacity is contacted with an air bag to hole therethrough, a second problem that a large amount of a floating misty residue might cause an asthmatic passenger to have a fit, and a third problem that a large amount of a floating misty residue might prevent a passengers' view to make accidents more serious. In order to prevent occurrence of such problems, it is required that a combustion residue should be cooled and filtered through a coolant/filter to remain in an inflator. To this end, however, it is necessary to install a large coolant/filter inside an inflator. In addition, when a large amount of a combustion residue is generated, a coolant/filter is likely to damage, and its function declines in a short time. Accordingly, for decreasing an amount of a combustion residue released outside an inflator, a method of developing a gas generating agent in which an amount of a combustion residue generated is substantially small is most desirable.

Further, it is currently required to more downsize an air bag inflator and to reduce its weight more. However, an existing gas generating agent in which an amount of a combustion reside is large requires an additional component such as a large filter for filtration of a combustion residue or the like. It is therefore difficult to more downsize an inflator itself. From this standpoint as well, a gas generating agent in which an amount of a combustion residue is decreased has been required.

DISCLOSURE OF THE INVENTION

This invention aims to provide a gas generating composition having excellent combustion characteristics as a gas generating agent in which an amount of a combustion residue generated is decreased.

This invention further aims to provide an inflator system using the above gas generating composition.

This invention provides a gas generating composition comprising a fuel made of nitroguanidine, guanidine nitrate or a mixture thereof and an oxidizing agent.

This invention further provides an inflator system using the gas generating composition.

The gas generating agent of this invention is, compared with gas generating agents disclosed so far, by far excellent because of the small amount of the combustion residue, whereby a gas generator can be downsized more to be applied to an air bag system.

PREFERRED EMBODIMENT OR THE INVENTION

The fuel used in this invention is made of nitroguanidine, guanidine nitrate or a mixture thereof. A mixing ratio of nitroguanidine and guanidine nitrate is not particularly limited.

The content of the fuel in the gas generating composition varies with types of an oxidizing agent, a chlorine neutralizer and a binder and an oxygen balance. It is preferably between 35 and 80% by weight, more preferably between 45 and 70% by weight.

Examples of the oxidizing agent used in this invention can include a perchloric acid salt, a nitric acid salt and a mixture thereof.

Examples of the perchloric acid salt and the nitric acid salt can include perchloric acid salts and nitric acid salts containing a cation selected from the group consisting of ammonium, alkali metals and alkaline earth metals. Examples of such perchloric acid salts and nitric acid salts can include ammonium perchlorate, sodium perchlorate, potassium perchlorate, magnesium perchlorate, barium perchlorate, ammonium nitrate, sodium nitrate, potassium nitrate, magnesium nitrate, strontium nitrate and the like. Of these, sodium perchlorate, magnesium perchlorate, sodium nitrate and mixtures thereof are especially preferable because the amount of the residue generated after combustion is small in particular.

As the oxidizing agent, the above-described compounds may be combined in any manner. However, the content of the oxidizing agent in the gas generating agent is preferably between 65 and 20% by weight, more preferably between 50 and 25% by weight.

When ammonium perchlorate is incorporated as the oxidizing agent, a chlorine neutralizer is incorporated for neutralizing a chlorine-type gas such as hydrogen chloride, a chlorine gas or the like for stabilization.

As the chlorine neutralizer, a compound containing a cation selected from the group consisting of alkali metals and alkaline earth metals can be proposed. As the compound containing such a cation, at least one can be proposed which is selected from the group consisting of carbonic acid salts such as sodium carbonate, potassium carbonate, magnesium carbonate, calcium carbonate, strontium carbonate and the like; nitric acid salts such as sodium nitrate, potassium nitrate, magnesium nitrate, calcium nitrate, strontium nitrate and the like; silicic acid salts such as sodium silicate, potassium silicate, magnesium silicate, calcium silicate, strontium silicate and the like; oxalic acid salts such as sodium oxalate, potassium oxalate, magnesium oxalate, calcium oxalate, strontium oxalate and the like; oxides such as magnesium oxide, calcium oxide, strontium oxide and the like; peroxides such as magnesium peroxide, calcium peroxide, strontium peroxide and the like; cellulose salts such as sodium carboxymethyl cellulose and the like; salts of tetrazole and triazole such as sodium salt, potassium salt, magnesium salt, calcium salt, strontium salt and the like of 5-aminotetrazole; salts of bitetrazole such as sodium salt, potassium salt, magnesium salt, calcium salt, strontium salt and the like of bitetrazole; and so forth.

The content of the chlorine neutralizer in the gas generating composition is preferably between 5 and 40% by weight, more preferably between 10 and 30% by weight.

Further, the gas generating composition can contain, as required, a binder, a combustion catalyst and the like.

Examples of the binder can include inorganic binders such as silica, alumina, molybdenum disulfide, Japanese acid clay, talc, bentonite, diatomaceous earth, kaolin and the like; and organic binders such as metal salts of carboxymethyl cellulose and the like, starch, microcrystalline cellulose, guar gum, polyacrylamide, polyvinyl alcohol, stearic acid metal salts, oligomers and the like.

Examples of the combustion catalyst can include CuO, $Cu_2O$, $Co_2O_3$, CoO, $Co_3O_4$, $Fe_2O_3$, FeO, $Fe_3O_4$, $MnO_2$, $Mn_2O_3$, $Mn_3O_4$, NiO, ZnO $MoO_3$, $CoMoO_4$, $Bi_2MoO_6$, $Bi_2O_3$ and the like.

It is advisable that the total amount of the additives in the gas generating composition is between 0.1 and 20% by weight.

In the gas generating composition of this invention, the gas composition after combustion can be changed by changing an oxygen balance. For example, it is possible to decrease CO (increase NOx) by changing the oxygen balance to the plus side. Conversely, it is possible to decrease NOx (increase CO) by changing the oxygen balance to the minus side. Accordingly, it is advisable to adjust the oxygen balance in consideration of the safety to human bodies.

The gas generating composition of this invention can be produced by a dry method of mixing a fuel, an oxidizing agent, a chlorine neutralizer, additives and the like in a powdery state or a wet method of mixing the same in the presence of water or an organic solvent.

Further, the gas generating composition of this invention can also be molded into a desired form. For example, it can be compression-molded into a pellet using a pelletizer or into a disk using a disk press machine, a pellet or a disk can be pulverized or granulated using a granulator to form granules or it can be extrusion-molded using an extruder (extrusion-molding machine) to form an extruded pellet (non-perforated, single-perforated or porous shape).

These molding methods can be selected, as required, according to properties and the like which are to be imparted to a molded article of the gas generating composition. For example, in the compression-molding method, inherently, a binder is not required or may be used in a small amount in the molding, so that this is suitable as a method of molding the gas generating composition of this invention. Further, when the extrusion-molding method is employed, it is easier to form an article of a thin web than the compression-molding method. Accordingly, a molded article of a thin web can be obtained with a composition having a low burning rate. Further, the extrusion-molding method is suited for mass-production because it is conducted for a relatively short period of time. Still further, in case of a composition having a high burning rate, a size of a molded article can be increased, making it possible to more improve a production efficiency. Besides, when the extrusion-molding method is employed, a molded article of a non-perforated, single-perforated or porous complicated shape can be produced, so that various combustion characteristics can be imparted.

In the gas generating composition of this invention, the amount of the combustion residue per 1 mol of a gas generated is preferably 12 g/mol or less, especially preferably 10 g/mol or less. This amount of the combustion residue is a total amount of components generated as a solid component and a liquid component in an inflator output temperature which is calculated according to the formulation of the gas generating composition.

The gas generating composition of this invention can be used in any device requiring a gas generating ability of a gun propellant or a rocket propellant. It is especially suited for an inflator system of an air bag installed in automobiles, airplanes and the like for protecting human bodies.

The inflator system of this invention uses the above-described gas generating composition, and they may be applied to a pyrotechnic inflator system, in which all the gas is supplied from a gas generating agent, or a hybrid inflator system, in which gas is supplied from both a compressed gas such as argon and a gas generating agent.

A gas generating method of this invention is a method in which the above-described gas generating composition is burned as a fuel in a gas generator, and it can be applied to various fields utilizing the gas generated by this burning. In the gas generating method of this invention, the gas generating composition is used as a fuel, making it possible to decrease the amount of the combustion residue and improve the gas output.

EXAMPLES

This invention is illustrated specifically with reference to the following Examples and Comparative Examples. However, this invention is not limited to these Examples only.

Examples 1 to 14 and Comparative Examples 1 to 3

Gas generating compositions having formulations shown in Table 1 were obtained. An amount of a combustion residue generated when each of these gas generating compositions generated 1 mol of a gas was measured. The amount of the combustion residue of the gas generating agent containing nitroguanidine, guanidine nitrate or a mixture thereof was shown as Examples, and an amount of a combustion residue measured by calculation in gas generating agents disclosed in JP-A 9-501137, JP-A 4-265292 and JP-A 6-239683 was shown as Comparative Examples 1 to 3.

The amount of the combustion residue in the gas generating compositions of this invention was much smaller than that in many gas generating agents disclosed to date.

Examples 15 to 28

Gas generating compositions having formulations shown in Table 2 were obtained. An amount of a gas generated from these gas generating compositions was measured.

It was identified that in the gas generating compositions of this invention, the amount of the gas generated was sufficient for an air bag.

Examples 29 to 41

Gas generating compositions having formulations shown in Table 3 were obtained. A burning rate of these gas generating compositions and a density of strands of the gas generating agents were measured. The burning rate was measured at a pressure of 70 kgf/cm$^2$.

It was identified that in the gas generating compositions of this invention, the burning rate was sufficient for an air bag.

Examples 42 to 52

Gas generating compositions having formulations shown in Table 4 were obtained. These compositions were subjected to a test for a thermal stability. In the test for the thermal stability, the composition placed in an aluminum container was allowed to stand in a constant-temperature bath of 105° C. for 400 hours, a weight loss ratio was found from the change in weight of the composition before and after the test, and the thermal stability was evaluated.

The weight loss of the compositions of this invention was slight, and no change in the appearance was observed.

Examples 53 to 63

Gas generating compositions having formulations shown in Table 5 were obtained. These compositions were subjected to a friction sensitivity test and a drop hammer test. The test for the friction sensitivity was conducted according to Standard ES-22 of the Industrial Explosives Society, Japan using a BAM-type friction sensitivity tester. The test for the drop hammer sensitivity was conducted according to Standard ES-21 (1) of the Industrial Explosives Society, Japan using an iron hammer of 5 kg.

It was identified that both of the friction sensitivity and the drop hammer sensitivity of the compositions in this invention were low and the safety was high.

TABLE 1

| | Formulation | wt.% | Amount of combustion residue based on amount of gas generated (g/mol) |
|---|---|---|---|
| Example 1 | nitroguanidine/$NaNO_3$ | (60.5/39.5) | 8.2 |
| Example 2 | nitroguanidine/$NaClO_4$ | (63/37) | 5.4 |
| Example 3 | nitroguanidine/$Mg(ClO_4)_2$ | (65.1/34.9) | 2.0 |
| Example 4 | guanidine nitrate/$NaNO_3$ | (64.2/35.8) | 7.1 |
| Example 5 | guanidine nitrate/$NaClO_4$ | (66.6/33.4) | 4.8 |
| Example 6 | guanidine nitrate/$Mg(ClO_4)_2$ | (66.6/31.4) | 1.6 |
| Example 7 | nitroguanidine/guanidine nitrate/$NaClO_4$ | (31.5/33.3/35.2) | 5.1 |
| Example 8 | nitroguanidine/$NH_4ClO_4NaNO_3$ | (56.2/25.4/18.4) | 3.6 |
| Example 9 | guanidine nitrate/$NH_4ClO_4NaNO_3$ | (60.1/23.1/16.8) | 3.2 |
| Example 10 | nitroguanidine/$NH_4ClO_4Na_2CO_3$ | (56/25/19) | 5.7 |
| Example 11 | nitroguanidine/$NH_4ClO_4Na_2SiO_3$ | (55/25/20) | 7.6 |
| Example 12 | nitroguanidine/$NH_4ClO_4Na_2C_2O_4$ | (54/25/21) | 5.2 |
| Example 13 | nitroguanidine/$NH_4ClO_4CaO_2$ | (50/25/25) | 7.2 |
| Example 14 | nitroguanidine/$NH_4ClO_4NaNO_3$/CMC-Na | (47.1/26.6/19.3/7) | 3.8 |
| Comparative Example 1 | 5-aminotetrazole/CuO | (23.4/75.6) | 44.5 |
| Comparative Example 2 | 5-aminotetrazole/$Sr(NO_3)_2/SiO_2$ | (33.1/58.9/8) | 16.5 |
| Comparative Example 3 | carbohydrazide/$KClO_4$/CaO | (39/61/10) | 14.2 |

TABLE 2

| | Formulation | wt. % | Amount of gas generated (mol/100 g) |
|---|---|---|---|
| Example 15 | nitroguanidine/$NaNO_3$ | (60.5/39.5) | 2.9 |
| Example 16 | nitroguanidine/$NaClO_4$ | (63/37) | 3.3 |
| Example 17 | nitroguanidine/$Mg(ClO_4)_2$ | (65.1/34.9) | 3.3 |
| Example 18 | guanidine nitrate/$NaNO_3$ | (64.2/35.8) | 3.2 |
| Example 19 | guanidine nitrate/$NaClO_4$ | (66.6/33.4) | 3.3 |
| Example 20 | guanidine nitrate/$Mg(ClO_4)_2$ | (68.6/31.4) | 3.5 |
| Example 21 | nitroguanidine/guanidine nitrate/$NaClO_4$ | (31.5/33.3/35.2) | 3.3 |
| Example 22 | nitroguanidine/$NH_4ClO_4/NaNO_3$ | (56.2/25.4/18.4) | 3.5 |
| Example 23 | guanidine nitrate/$NH_4ClO_4/NaNO_3$ | (60.1/23.1/16.8) | 3.6 |
| Example 24 | nitroguanidine/$NH_4ClO_4/Na_2CO_3$ | (56/25/19) | 3.5 |
| Example 25 | nitroguanidine/$NH_4ClO_4/Na_2SiO_3$ | (55/25/20) | 3.2 |
| Example 26 | nitroguanidine/$NH_4ClO_4/Na_2C_2O_4$ | (54/25/21) | 3.4 |
| Example 27 | nitroguanidine/$NH_4ClO_4/CaO_2$ | (50/25/25) | 3.0 |
| Example 28 | nitroguanidine/$NH_4ClO_4/NaNO_3$/CMC-Na | (47.1/26.6/19.3/7) | 3.5 |

TABLE 3

| | Formulation | wt. % | Burning rate (mm/sec) | Density ($g/cm^3$) |
|---|---|---|---|---|
| Example 29 | nitroguanidine/$NaNO_3$ | (60.5/39.5) | 11.8 | 1.74 |
| Example 30 | nitroguanidine/$KNO_3$ | (56.3/43.7) | 32.9 | 1.72 |
| Example 31 | nitroguanidine/$Sr(NO_3)_2$ | (55.1/44.9) | 7.7 | 1.90 |
| Example 32 | nitroguanidine/$NaClO_4$ | (63/37) | 19.7 | 1.82 |
| Example 33 | nitroguanidine/$KClO_4$ | (60.1/39.9) | 27.5 | 1.79 |
| Example 34 | nitroguanidine/$Mg(ClO_4)_2$ | (65.1/34.9) | 7.4 | 1.65 |
| Example 35 | nitroguanidine/$NH_4ClO_4/NaNO_3$ | (56.2/25.4/18.4) | 16.2 | 1.72 |
| Example 36 | nitroguanidine/$NH_4ClO_4/NaNO_3$ | (57/20.6/22.4) | 17.2 | 1.72 |
| Example 37 | guanidine nitrate/$KNO_3$ | (60.1/39.9) | 4.2 | 1.62 |
| Example 38 | guanidine nitrate/$NaClO_4$ | (66.6/33.4) | 6.4 | 1.65 |
| Example 39 | guanidine nitrate/$KClO_4$ | (63.8/36.2) | 14.0 | 1.69 |
| Example 40 | guanidine nitrate/$Mg(ClO_4)_2$ | (68.6/31.4) | 3.6 | 1.54 |
| Example 41 | guanidine nitrate/$NH_4ClO_4/NaNO_3$ | (60.1/23.1/16.8) | 9.4 | 1.63 |

TABLE 4

| | Formulation | wt. % | Weight loss ratio (%) |
|---|---|---|---|
| Example 42 | nitroguanidine/$NaNO_3$ | (60.5/39.5) | −0.11 |
| Example 43 | nitroguanidine/$NaClO_4$ | (63/37) | −0.15 |
| Example 44 | nitroguanidine/$Mg(ClO_4)_2$ | (65.1/34.9) | −0.37 |
| Example 45 | nitroguanidine/$KClO_4$ | (60.1/39.9) | −0.11 |
| Example 46 | nitroguanidine/$NH_4ClO_4$/$NaNO_3$ | (56.2/25.4/18.4) | −0.11 |
| Example 47 | guanidine nitrate/$NaClO_4$ | (66.6/33.4) | −0.06 |
| Example 48 | guanidine nitrate/$KClO_4$ | (63.8/36.2) | −0.07 |
| Example 49 | guanidine nitrate/$KNO_3$ | (50.1/39.9) | −0.07 |
| Example 50 | guanidine nitrate/$NH_4ClO_4$/$NaNO_3$ | (60.1/23.1/16.8) | −0.06 |
| Example 51 | nitroguanidine/$NH_4ClO_4$/$Na_2CO_3$ | (56/25/19) | −0.09 |
| Example 52 | nitroguanidine/$NH_4ClO_4$/$NaNO_3$/CMC-Na | (47.1/26.6/19.3/7) | −0.09 |

TABLE 5

| | Formulation | wt. % | Friction sensitivity (kgf) | Drop hammer sensitivity (cm) |
|---|---|---|---|---|
| Example 53 | nitroguanidine/$NaNO_3$ | (60.5/39.5) | >36 | 90–100 |
| Example 54 | nitroguanidine/$NaClO_4$ | (63/37) | >36 | 40–50 |
| Example 55 | nitroguanidine/$Mg(ClO_4)_2$ | (65.1/34.9) | >36 | >100 |
| Example 56 | nitroguanidine/$KClO_4$ | (60.1/39.9) | >36 | 30–40 |
| Example 57 | nitroguanidine/$NH_4ClO_4$/$NaNO_3$ | (56.2/25.4/18.4) | >36 | 80–90 |
| Example 58 | guanidine nitrate/$NaClO_4$ | (66.6/33.4) | >36 | >100 |
| Example 59 | guanidine nitrate/$KClO_4$ | (63.6/36.2) | >36 | 70–80 |
| Example 60 | guanidine nitrate/$KNO_3$ | (60.1/39.9) | >36 | 90–100 |
| Example 61 | guanidine nitrate/$NH_4ClO_4$/$NaNO_3$ | (60.1/23.1/16.8) | >36 | 80–90 |
| Example 62 | nitroguanidine/$NH_4ClO_4$/$Na_2CO_3$ | (56/25/19) | >36 | 40–50 |
| Example 63 | nitroguanidine/$NH_4ClO_4$/$NaNO_3$/CMC-Na | (47.1/26.6/19.3/7) | >36 | 80–90 |

What is claimed is:

1. A gas generating composition comprising a fuel made of nitroguanidine, guanidine nitrate, or a mixture thereof, an ammonium perchlorate oxidizing agent, a chlorine neutralizer, and a sodium carboxymethylcellulose binder.

2. The gas generating composition of claim 1, wherein the chlorine neutralizer is a compound containing a cation selected from the group consisting of alkali metals and alkaline earth metals.

3. The gas generating composition of claim 2, wherein the content of the fuel is between 35 and 80% by weight, and the content of the oxidizing agent is between 65 and 20% by weight.

4. The gas generating composition of claim 1, which further comprises a combustion catalyst as an additive.

5. The gas generating composition of claim 1, wherein an amount of a combustion residue based on an amount of gas generated is 12 g/mol or less.

6. An inflator system using the gas generating composition of claim 1.

7. The gas generating composition of claim 1, wherein the chlorine neutralizer is selected from the group consisting of a silicic acid salt, an oxalic acid salt, an oxide, a peroxide, a cellulose salt, a salt of tetrazole, a salt of triazole, and a salt of bitetrazole.

* * * * *